US005687803A

United States Patent [19]

Wentworth et al.

[11] Patent Number: 5,687,803

[45] Date of Patent: Nov. 18, 1997

[54] METHOD FOR REVERSING A GROUND PIERCING TOOL

[75] Inventors: Steven W. Wentworth, Brookfield; Robert Crane, Oconomowoc; Mark Randa, Muskego, all of Wis.

[73] Assignee: Earth Tool Company, L.L.C., Oconomowoc, Wis.

[21] Appl. No.: 533,074

[22] Filed: Sep. 25, 1995

[51] Int. Cl.[6] ..... E21B 4/14; E21B 7/08; B25D 9/00

[52] U.S. Cl. ..... 175/19; 173/91; 173/137; 175/73; 175/296

[58] Field of Search ..... 175/19–21, 317, 175/296, 73, 74; 405/184, 232; 173/91, 90, 139, 206, 135, 138; 285/316

[56] References Cited

U.S. PATENT DOCUMENTS

| | | | |
|---|---|---|---|
| 1,637,908 | 8/1927 | Lea . | |
| 3,265,408 | 8/1966 | Dickie . | |
| 3,267,963 | 8/1966 | Hupp . | |
| 3,606,394 | 9/1971 | Maurer et al. . | |
| 3,756,328 | 9/1973 | Sudnishnikov et al. | 173/91 |
| 3,964,771 | 6/1976 | Baudouin . | |
| 3,966,236 | 6/1976 | Vann . | |
| 4,014,467 | 3/1977 | Ferguson . | |
| 4,331,207 | 5/1982 | Castel | 175/317 |
| 4,543,993 | 10/1985 | Calvin et al. . | |
| 4,618,007 | 10/1986 | Kayes | 175/19 |
| 4,662,457 | 5/1987 | Bouplon | 173/91 |
| 4,872,516 | 10/1989 | MacFarlane et al. | 173/139 X |
| 5,025,868 | 6/1991 | Wentworth et al. . | |
| 5,199,151 | 4/1993 | Wentworth et al. . | |
| 5,318,135 | 6/1994 | Kayes | 175/19 |
| 5,494,116 | 2/1996 | Wentworth | 175/296 X |
| 5,505,270 | 4/1996 | Wentworth | 173/91 X |

FOREIGN PATENT DOCUMENTS 1170167 11/1969 United Kingdom .

OTHER PUBLICATIONS

Perfecting Service Division Catalog —Couplings and Accessories.

*Primary Examiner*—Dennis L. Taylor
*Attorney, Agent, or Firm*—Philip G. Meyers

[57] ABSTRACT

The invention provides a method for reversing an impact boring tool of the type having a reversing mechanism actuated by rotation of the compressed air supply hose that enters the tool through a rear end opening. This method includes the initial step of connecting the air supply hose to the tool using a quick-release coupling device including tubular male and female members which are coupled together, one of the members being mounted on the end of the air supply hose and the other mounted on an air inlet conduit of the tool, the coupling device further having a locking sleeve and a ball seated in a first pit in one of the members and configured for insertion into a second pit in the other of the members as the locking sleeve moves over the ball, the locking sleeve being biased to a locked position wherein the ball is seated in both pits thereby preventing rotation of one member relative to the other as well as disengagement of one member from the other. The tool is then operated for earth boring, the direction of travel of the tool is then reversed by rotating the air hose, which rotation is transmitted to the air inlet conduit of the tool by the ball of the coupling device.

4 Claims, 2 Drawing Sheets

METHOD FOR REVERSING A GROUND PIERCING TOOL

TECHNICAL FIELD

This invention relates to pneumatic impact tools, particularly to a method of operating a self-propelled ground piercing tools capable of forward and reverse travel.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

Wentworth et al. U.S. Pat. No. 5,025,868 describes a ground-piercing tool having an improved form of screw-reverse mechanism, a unique striker having annular bearing rings at each end, and a removable, axially clamp-loaded end-cap assembly that facilitates repair and reassembly of the tool. Wentworth et al. U.S. Pat. No. 5,199,151 describes a tool of similar construction wherein the tool body is made by rotary swaging rather than by machining a solid metal bar.

When using the tools described in the foregoing patents, it is desirable that the air supply hose for connecting the tool to the compressor include a quick-release coupling device. This coupling device typically includes metallic male and female members and a locking device which allows easy coupling and uncoupling of the tool from the air supply and allows additional segments of hose to be added as the tool progresses.

One such quick-release coupling device, generally known as an "E" series connector, includes metallic male and female members for coupling together and a locking sleeve disposed on the outside of the female member used in conjunction with a series of balls disposed in pits in the female member for insertion into an annular groove in the male member. When the balls are engaged in the annular groove and held in place by the locking sleeve, which is spring-biased to its locked position, the members remain coupled until the locking sleeve is manually released.

Although the above described "E" series connector is widely available, it is not suitable for many of the foregoing tools. In particular, known self-propelled pneumatic impact tools of the type described in the foregoing patents are generally reversed by turning the air hose in order to displace the stepped air inlet by means of the screw reverse mechanism. Since the balls in "E" series female connector couple with an annular groove in the male member, the coupling permits the male and female members to rotate freely relative to one another and, thus, prevents torque from being transmitted through the coupling. Therefore, this coupling is only suitable for tools which either only have a forward mode of operation or for tools which are switched into reverse other than by rotating the air supply hose.

One particular coupling device that does pass torque and, thus, is usable with the above reversible tools, is commonly called an "N Series" connector. This coupling device includes a male member having a locking device including a pair of radially opposite flanges, a retractable sleeve having a pair of tongues and a threaded locking ring. The female member includes a pair of grooves designed to interlock with the tongues of the male member, and a pair of lips designed to interlock with a respective flange of the male member. The members are connected by a pushing and twisting motion and then secured together by turning the locking ring. However, the smallest commercially available coupler of this type is significantly larger than the smallest "E" series coupler and, in general, is larger than optimal for smaller earth boring tools, particularly for tools less than 3 inches in diameter.

It would be desirable to have a novel coupling device which is quick and easy to operate, which transmits torque, and which is smaller in size than commercially available couplers with these features.

SUMMARY OF THE INVENTION

The present invention provides a simplified coupling device wherein each of one or more retaining balls is disposed in a pit in both coupling members. A method for reversing an impact boring tool of the type having a reversing mechanism actuated by rotation of the compressed air supply hose that enters the tool through a rear end opening thereof according to the invention comprises the initial step of connecting the air supply hose to the tool using a quick-release coupling device including tubular male and female members which are coupled together, one of the members being connected to the end of the air supply hose and the other connected to an air inlet conduit of the tool, the coupling device further having a locking sleeve and a ball seated in a first pit in one of the members and configured for insertion into a second pit in the other of the members as the locking sleeve moves over the ball, the locking sleeve being biased to a locked position wherein the ball is seated in both pits thereby preventing rotation of one member relative to the other as well as disengagement of one member from the other. The tool is then operated for earth boring in either forward or reverse mode. When necessary, the direction of travel of the tool is reversed by rotating the air hose, which rotation is transmitted to the air inlet conduit of the tool by the ball of the coupling device.

Other objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
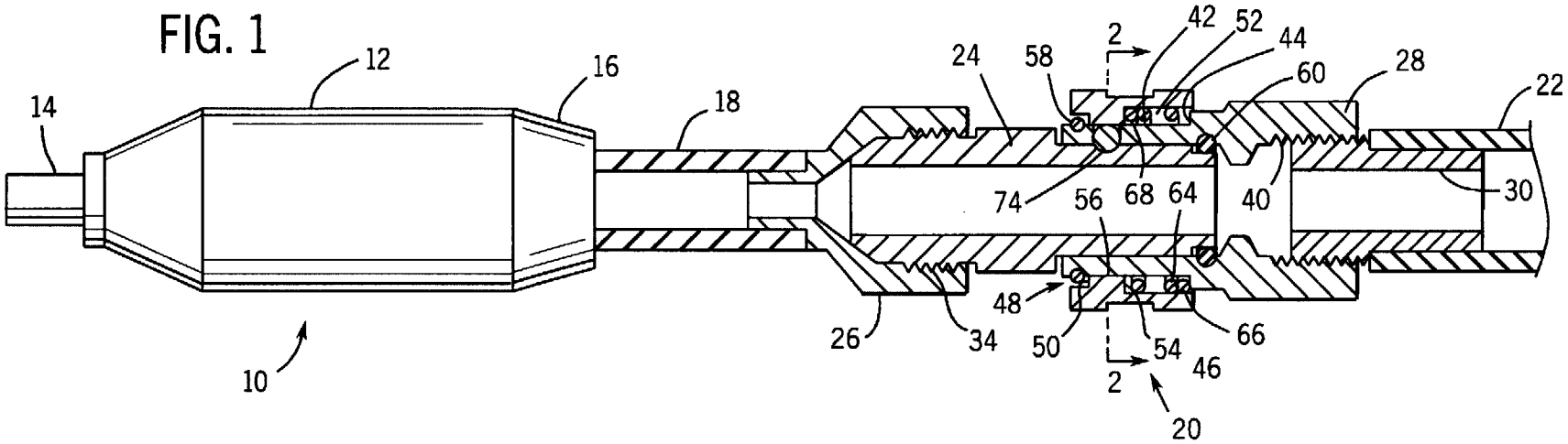
FIG. 1 is a lengthwise sectional view of a boring tool having a reversing mechanism actuated by rotation of the air supply hose that enters the tool through a rear end opening and a quick-release coupling device according to the invention.
Figure 2:
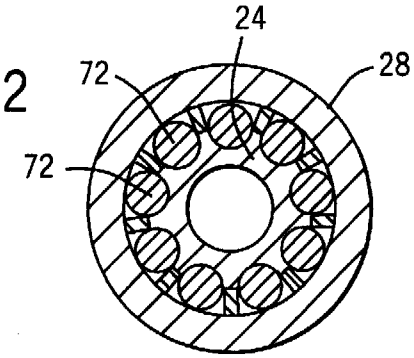
FIG. 2 is a cross-sectional view of the coupler of FIG. 1, taken along line 2—2.
Figure 3:
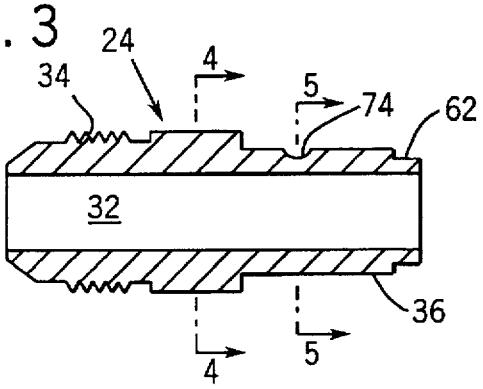
FIG. 3 is a lengthwise sectional view of a male member of the quick-release coupling according to the invention.
Figure 4:
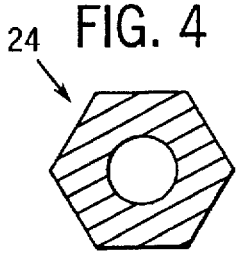
FIG. 4 is a cross-sectional view of the male member of FIG. 3, taken along line 4—4.
Figure 5:
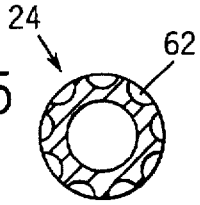
FIG. 5 is a cross-sectional view of the male member of FIG. 3, taken along line 5—5.
Figure 7:
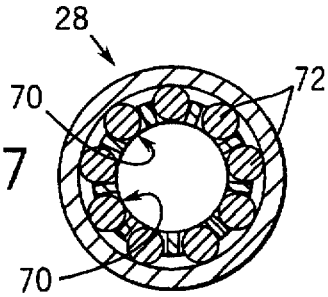
FIG. 7 is a cross-sectional view of the female member of FIG. 6, taken along line 7—7.
Figure 8:
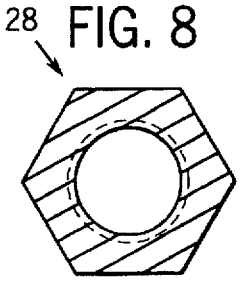
FIG. 8 is a cross-sectional view of the female member of FIG. 7, taken along line 8—8.
Figure 6:
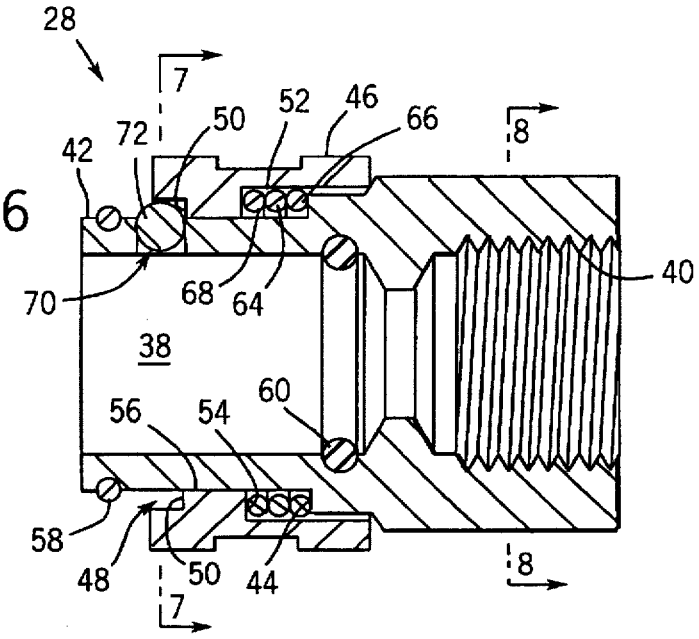
FIG. 6 is a lengthwise sectional view of a female member of the quick-release coupling according to the invention.

Referring now to FIG. 1, a pneumatic ground piercing tool 10 according to the invention includes, as main components, a tool body 12 which includes a head assembly 14 and a tail assembly 16 which allows exhaust air to escape from tool 10. Tail assembly 16 includes a air inlet conduit 18, and a means for allowing reverse operation of tool 10 actuated by rotating air inlet conduit 18. This may be a conventional screw reverse mechanism as exemplified by Wentworth et al. U.S. Pat. No. 5,025,868, and other known reversing mechanisms that rely on twisting the air supply hose to actuate the mechanism. Air inlet conduit 18, in turn, is coupled by a quick-release coupling device 20 to a flexible air supply hose 22 which ultimately connects to the air compressor.

Referring now to FIGS. 2 through 8, coupler 20 includes a male member 24 threadedly secured to a first adaptor 26 attached to air inlet conduit 18, and a female member 28 threadedly secured to a second adaptor 30 attached to air supply hose 22. Male member 24 has a central axial bore 32, an externally threaded end portion 34, and a diametrically reduced outer end portion 36 opposite threaded end portion 34. Female member 28 has a central axial bore 38 for receiving reduced outer end portion 36 of male member 24 therein, an internally threaded end portion 40, and a diametrically reduced outer end portion 42 opposite internally threaded end portion 40 defining a first shoulder 44. When members 24 and 28 are coupled, central bores 32 and 38 are in alignment.

Female member 28 also includes a locking sleeve 46 slidably axially received over reduced outer end portion 42. Sleeve 46 includes a short counterbore at one end thereof defining a ball relief chamber 48 and a ramp 50, and a long counterbore at an opposite end thereof defining a spring chamber 52 and a second shoulder 54 in opposition with first shoulder 44. Sleeve 46 includes a ball pressure extension 56 intermediate ramp 50 and shoulder 54 which remains in close contact with reduced outer end portion 42 of female member 28. Preferably, female member 28 also includes a metal ring 58 secured around an outer surface of reduced diameter portion 42 and a rubber ring 60 positioned around an inner surface. Metal ring 58 provides a stop for sleeve 46 by engaging ramp 50 to prevent sleeve 46 from being removed, and rubber ring 60 engages a seat 62 formed on an outer end of reduced diameter portion 36 of male member 24 to prevents leakage of air from coupling 20.

A coil compression spring 64 is received in spring chamber 52 of sleeve 46 and is slidably received over reduced outer end portion 42 of female member 28. Spring 64 has opposite ends 66 and 68 in abutting relationship with opposed shoulders 44 and 54, respectively, to bias locking sleeve 46 into a locked direction.

Reduced outer end portion 42 of female member 28 includes a plurality of diametrically opposed radially inwardly tapering apertures 70 in a circumferentially spaced arrangement. A plurality of balls 72 are disposed in apertures 70, one ball per aperture. Reduced outer end portion 36 of male member 24 includes a plurality of recesses 74 for the simultaneous reception of balls 72 when held therein by ball pressure extension 56.

When coupling 20 is in the locked position (i.e., when balls 72 are simultaneously seated in apertures 70 and recesses 74), sleeve 46 may be slid rearwardly to compress bias spring 64 until ball relief chamber 48 is directly over balls 72, allowing balls 72 to move radially outward to allow coupling 20 to be opened. A conventional pin and slot mechanism (not shown) is preferably provided to hold sleeve 46 in its locked position while the tool is in use. When coupling 20 is in the unlocked position, the bias pressure of spring 64 presses sleeve 46 toward balls 72, causing ramp 50 to force balls 72 radially inward into recesses 74. With this arrangement, it can be seen that when balls 72 are simultaneously seated in apertures 70 and recesses 74, rotation of one member relative to the other as well as disengagement of one member from the other is prevented.

The invention also includes a method for reversing an impact boring tool of the type having a reversing mechanism actuated by rotation of the compressed air supply hose that enters the tool through a rear end opening. The method includes connecting air supply hose 22 to tool 10 using quick-release coupling 20 including tubular male member 24 and female member 28 coupled together. Female member 28 is mounted on to air supply hose 22 leading to the compressor and male member 24 is mounted to air inlet conduit 18 of tool 10. The method further includes the steps of operating tool 10 for earth boring, reversing the direction of travel of tool 10 by rotating air hose 22, which rotation is transmitted to air inlet conduit 18 of tool 10 by balls 72 of coupling 20.

It will be understood that the foregoing description is of preferred exemplary embodiments of the invention, that the invention is not limited to the specific forms shown, and that the scope of the invention as expressed in the appended claims.

We claim:

1. A method for reversing an impact boring tool of the type having a reversing mechanism actuated by rotation of the compressed air supply hose that enters the tool through a rear end opening thereof, comprising the steps of:

connecting the air supply hose to the tool using a quick-release coupling device including tubular male and female members which are coupled together, one of the members being mounted on the end of the air supply hose and the other mounted on an air inlet conduit of the tool, the coupling device further having a locking sleeve and a ball seated in a first pit in one of the members and configured for insertion into a second pit in the other of the members as the locking sleeve moves over the ball, the locking sleeve being biased to a locked position wherein the ball is seated in both pits thereby preventing rotation of one member relative to the other as well as disengagement of one member from the other;

operating the tool for earth boring; and reversing the direction of travel of the tool by rotating the air hose, which rotation is transmitted to the air inlet conduit of the tool by the ball of the coupling device.

2. The method of claim 1, further comprising uncoupling the air supply hose from the tool by pulling back on the locking sleeve against the force of a spring which biases the locking sleeve towards a locked position.

3. The method of claim 1, wherein the coupling device has a series of balls and associated pits disposed in a circular formation about a lengthwise axis of the air supply hose.

4. The method of claim 1, wherein the coupling device is disposed proximate a rear end of the impact boring tool.

* * * * *